US009152115B2

(12) United States Patent
Sasaoka et al.

(10) Patent No.: US 9,152,115 B2
(45) Date of Patent: Oct. 6, 2015

(54) IMAGE FORMING APPARATUS THAT EMPLOYS ELECTROPHOTOGRAPHIC METHOD

(75) Inventors: Osamu Sasaoka, Yokohama (JP); Yuichiro Inaba, Chigasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 230 days.

(21) Appl. No.: 13/189,079

(22) Filed: Jul. 22, 2011

(65) Prior Publication Data

US 2012/0045256 A1 Feb. 23, 2012

(30) Foreign Application Priority Data

Aug. 20, 2010 (JP) ..... 2010-185580

(51) Int. Cl.
*G03G 15/00* (2006.01)

(52) U.S. Cl.
CPC .... *G03G 15/5058* (2013.01); *G03G 2215/0161* (2013.01); *G03G 2215/0177* (2013.01)

(58) Field of Classification Search
CPC ..... G03G 15/5058; G03G 2215/0161; G03G 2215/0177
USPC ..... 399/301
See application file for complete search history.

(56) References Cited

U.S. PATENT DOCUMENTS 6,094,557 A 7/2000 Shinohara
6,445,900 B2 * 9/2002 Fukao et al. ..... 399/302
6,816,178 B2 * 11/2004 Yamada et al. ..... 347/116
7,208,254 B2 * 4/2007 Yuasa et al. ..... 430/108.2
7,286,789 B2 * 10/2007 Umezawa ..... 399/227
2009/0190972 A1 * 7/2009 Ohkubo et al. ..... 399/301
2009/0263167 A1 * 10/2009 Kitao ..... 399/301

FOREIGN PATENT DOCUMENTS

JP 9-171281 A 6/1997
JP 2000-066475 A 3/2000
JP 2000-231236 A 8/2000
JP 2001-134040 A 5/2001
JP 2005-62378 A 3/2005
JP 2010-128479 A 6/2010

OTHER PUBLICATIONS

Notice of Reasons for Refusal dated Mar. 1, 2013, in Japanese Application No. 2010-185580.
Notice of Reasons for Refusal dated Jul. 17, 2012, in Japanese Application No. 2010-185580.

* cited by examiner

*Primary Examiner* — Ryan Walsh
*Assistant Examiner* — Philip Marcus T Fadul
(74) *Attorney, Agent, or Firm* — Fitzpatrick, Cella, Harper & Scinto

(57) ABSTRACT

The formation position of a primary-transferred toner image is corrected by using, as a reference, a timing at which a marker that rotates together with a rotating member is detected by a marker detecting unit for detecting the marker, after part of a preparation operation in which a processing unit is caused to contact or depart from the rotating member is finished.

9 Claims, 16 Drawing Sheets

IMAGE FORMING APPARATUS THAT EMPLOYS ELECTROPHOTOGRAPHIC METHOD

BACKGROUND OF THE INVENTION

1. Field of the Invention

The present invention relates to an image forming apparatus that employs an electrophotographic method.

2. Description of the Related Art

Conventionally, multi-color image forming apparatuses that employ a so-called multipath system (also called a "four-path system") are known in which toner images of the four colors yellow, cyan, magenta and black, are sequentially superposed on a transferring member. In such multi-color image forming apparatuses, if the positions in which images of a plurality of colors are superposed are relatively displaced among the colors, color misalignment occurs. For this reason, it is necessary to perform positional alignment among the toner images of the respective colors to be superposed on the member as accurately as possible.

On the other hand, there is a demand for reducing the user waiting time from inputting a print job to the first printout, improving productivity and the like in multi-color image forming apparatuses from the viewpoint of usability. This applies also to the above-described multipath printers. In the multipath system printers, a mode is already known in which processes that have been performed in series in conventional printers are performed in parallel. For example, it is conceivable to change execution of secondary transfer of the toner image of the previous page and primary transfer of the toner image of the next page from conventional serial execution to parallel execution.

In such a mode, for example, cases in which cleaning or the like is performed and is not performed in parallel with the primary transfer operation for the last color of a plurality of colors subjected to primary transfer both occur. In this case, if a mechanical shock occurs due to members coming into contact and separating in relation to cleaning or the like, the condition of a load applied to the image forming units differs for each image forming color. As a result, color misalignment occurs.

In Japanese Patent Laid-Open No. 2000-66475, a registration correction control technique is proposed in which in a multipath system electrophotographic printer, consideration is given to displacement of the latent image formation position or the primary transfer position depending on whether or not there is a mechanical shock at the time of primary transfer of a toner image. Specifically, Japanese Patent Laid-Open No 2000-66475 proposes a technique for correcting the image-writing start timing in the case where there is a mechanical shock.

The above-described mechanical shock may be caused by random factors or the like, and it is difficult to accurately predict the amount of color misalignment that will actually occur. That is, it is difficult to predict the amount of color misalignment caused by a mechanical shock and correct that color misalignment, and thus it is desired to further improve prediction accuracy.

On the other hand, as another issue, in recent years, further reduction in the size, cost and the like of image forming apparatuses has been sought. With the reduction in size, cost or the like, innovative ways of correcting color misalignment are sought more strongly than ever.

Note that it is possible to avoid color misalignment due to a mechanical shock by serially performing image formation of a certain page, an operation causing a mechanical shock and image formation of the next page in order to perform image formation while avoiding the above-described mechanical shock. However, this results in deterioration in the productivity of image formation, that is, deterioration in usability.

SUMMARY OF THE INVENTION

The present invention prevents deteriorating usability and at the same time, improves color misalignment correction accuracy.

The present invention provides an image forming apparatus comprising the following element. An image bearing member bears a toner image. A development unit included a plurality of developing devices that each develops a latent image by using a toner of a different color. A rotating member operates as an intermediate transfer member onto which the toner image formed on the image bearing member is primary-transferred, or as a transferring material bearing member that bears a recording material onto which the toner image is primary-transferred and rotates. A marker detecting unit detects a marker that is formed on the rotating member and rotates with the rotating member. A control unit performs a preparation operation in which a processing unit is caused to contact or depart from the rotating member. A correcting unit, after part of the preparation operation is finished, corrects a formation position of the primary-transferred toner image by using a timing at which the marker is detected by the marker detecting unit as a reference.

Further features of the present invention will become apparent from the following description of exemplary embodiments (with reference to the attached drawings).

DESCRIPTION OF THE EMBODIMENTS

Embodiment 1

Outline of Image Forming Operation of Multi-Color Image Forming Apparatus

Figure 1:
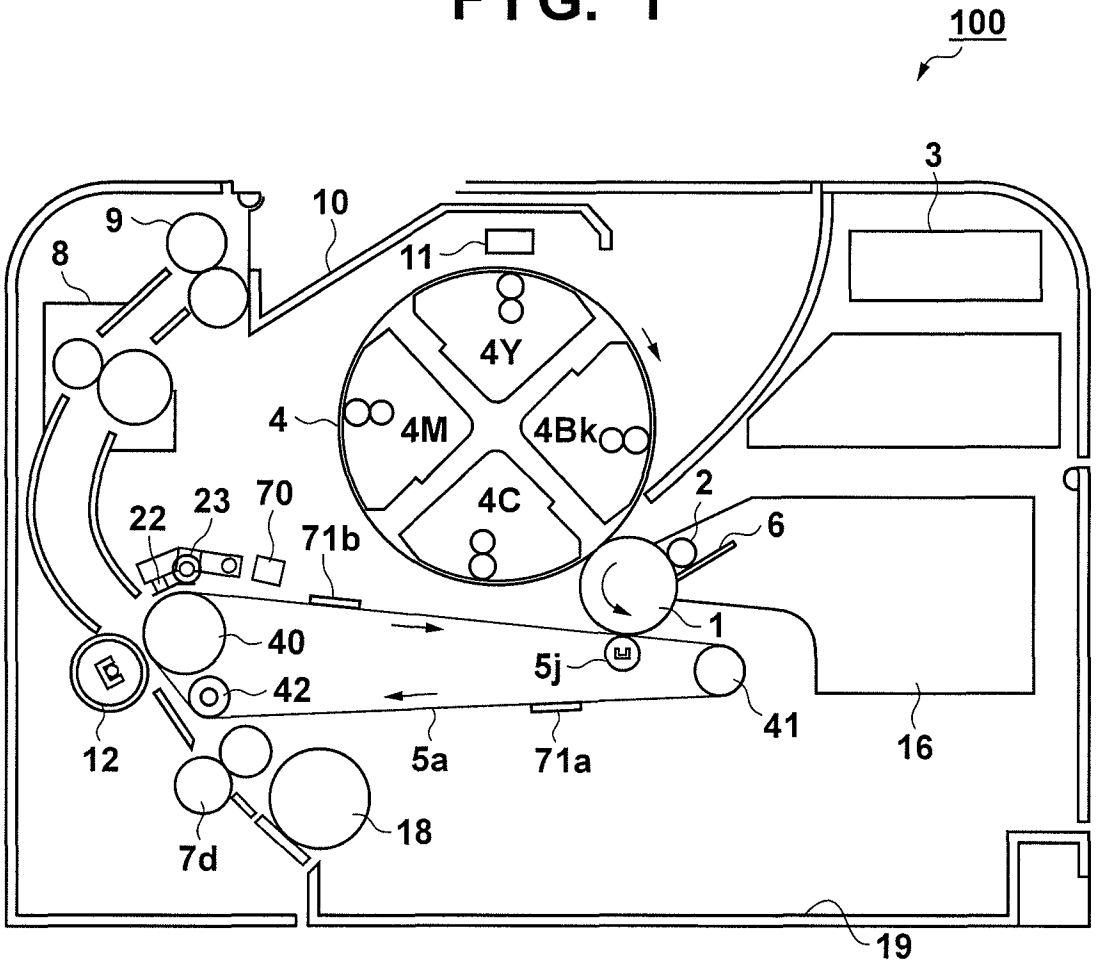
FIG. 1 is a diagram illustrating a main cross section of a main body of an image forming apparatus.

The image forming apparatus shown in FIG. 1 is described by using a four-cycle multi-color laser printer of the rotary system (in which a developing device rotates) as an example. A photosensitive drum 1 rotates in the direction indicated by the arrow in FIG. 1 (counter-clockwise). The photosensitive drum 1 is an example of an image bearing member that sequentially bears toner images of a plurality of colors. A charging roller 2 evenly charges the surface of the photosensitive drum 1. In addition, as a result of an exposure device 3, which is also referred to as an optical scanning device, irradiating a light beam according to a document image onto the surface of the photosensitive drum 1, an electrostatic latent image is formed. The timing for starting writing an electrostatic latent image (image formation start timing) by the exposure device 3 is set based on a signal (ITB_TOP) output from an optical sensor 70. An intermediate transfer belt 5*a* (intermediate transfer member) is an example of a rotating member onto which toner images of a plurality of colors formed on the image bearing member are primary-transferred. The intermediate transfer belt 5*a* is provided with a plurality of markers 71*a* and 71*b*. The markers 71*a* and 71*b* are provided on the intermediate transfer member, and are an example of a plurality of markers that rotate with the intermediate transfer member. The optical sensor 70 is an example of a marker detecting unit. The reflectance of the markers 71*a* and 71*b* is notably different from the reflectance on the surface of the intermediate transfer belt 5*a*. Accordingly, light is emitted toward the intermediate transfer belt 5*a* from a light-emitting element of the optical sensor 70, and light that is reflected thereby and returned is received by a light-receiving element of the optical sensor 70, thereby detecting the markers 71*a* and 71*b*. The markers 71*a* and 71*b* need not be an optical reflecting member, and may be any member such as a magnet or magnetic body, a resistor member or the like, if the member has different physical characteristics from those of the surface of the intermediate transfer belt 5*a*. In this case, a sensor capable of detecting the difference in the physical characteristics between the surface of the intermediate transfer belt 5*a* and the markers is employed instead of the optical sensor 70.

A rotary developing apparatus 4 is a developing apparatus that has a plurality of developing devices for developing latent images by using toners of different colors, and rotates to switch a developing device that contacts the image bearing member. When a yellow toner image is to be formed, the rotary developing apparatus 4 is driven to rotate by a driving motor, and a yellow developing device 4Y is positioned at a development position. The development position refers to the position at which the yellow developing device 4Y contacts the photosensitive drum 1 opposing each other. The developing device 4Y rotates as a result of a driving force from the driving motor being transmitted thereto from a development coupling not shown in the drawings. The development coupling is configured by a developing device-side development coupling provided in an end portion on the developing device side, and a main body-side development coupling with which the developing device-side development coupling engages. The developing device 4Y applies, to yellow toner, a voltage that has the same polarity as the charging polarity on the photosensitive drum 1 and has substantially the same potential as that on the photosensitive drum 1, such that the yellow toner adheres to the electrostatic latent image on the photosensitive drum 1.

On the other hand, the intermediate transfer belt 5*a* as the rotating member is stretched in a tensioned state across a driving roller 40, a first driven roller 41 and a second driven roller 42. The first driven roller 41 is also referred to as a tension roller since it applies an appropriate tension to the intermediate transfer belt 5*a*. Also, the second driven roller 42 is also referred to as an idler roller. As a result of a voltage that has a polarity opposite to that of toner being applied to a primary transfer roller 5*j* in the intermediate transfer belt unit, the yellow toner image on the photosensitive drum 1 is primary-transferred onto the intermediate transfer belt 5*a*.

When the primary transfer of the yellow toner image is finished, the rotary developing apparatus 4 rotates 90°, and a developing device 4M for magenta moves to the development position. Thereafter, similar to the case of yellow, creation of an electrostatic latent image, development and primary transfer is sequentially performed for each of the colors magenta, cyan and black, such that toner images of four colors are superposed on the intermediate transfer belt 5*a*. The rotary developing apparatus 4 can rotate 360°, and its position is detected by a rotary position detection sensor 11.

While primary transfer is being executed, a secondary transfer roller 12 (secondary transfer unit) is departed from the intermediate transfer belt 5*a* (in a non-contact state). Similarly, a charging brush 22 and a charging roller 23 included in a cleaning unit are also in a non-contact state with respect to the intermediate transfer belt 5*a*. This is for preventing the toner images from being damaged during the multiple transfer operation before a multi-color image is completed.

When the toner images of the four colors are subjected to multiple transfer in a superposing manner on intermediate transfer belt 5*a*, a multi-color image is completed on the intermediate transfer belt 5*a*. Next, the secondary transfer roller 12 moves so as to contact the intermediate transfer belt 5*a* (in a contact state) as shown in FIG. 1, for executing secondary transfer. Synchronized with the rotation of the intermediate transfer belt 5*a*, recording media accommodated in a paper feed device 19 are separated and fed to a transport path sheet-by-sheet by a pickup roller 18. The recording medium standing by at a predetermined position is fed to a nip portion between the intermediate transfer belt 5*a* and the secondary transfer roller 12 by transport rollers 7*d*, which are also referred to as registration rollers. The secondary transfer roller 12 is applied with a voltage having a polarity opposite to the toner polarity, and the toner images on the intermediate transfer belt 5*a* are secondary-transferred to the surface of the recording medium at one time.

The recording medium onto which the toner images have been secondary-transferred is transferred to a fixing device 8, where the toner images are fixed onto the recording medium. The recording medium subjected to fixing processing is discharged to a discharge tray 10 of an image forming apparatus 100 by a discharge roller pair 9. This completes image formation. On the other hand, the charging brush 22 and the charging roller 23 contact the intermediate transfer belt 5*a* after primary transfer, and apply an electrical charge opposite to that applied at the time of transfer to residual toner on the intermediate transfer belt 5*a*. The residual toner applied with the opposite electrical charge electrostatically adheres to the photosensitive drum 1. After that, the residual toner is collected in a waste toner box 16 by a cleaning blade 6 for the photosensitive drum 1.

The above described cleaning unit (charging brush 22, charging roller 23) and a secondary transfer unit (secondary transfer roller 12) are referred to as processing units since they contact and/or depart from the intermediate transfer belt 5*a* serving as the rotating member and perform part of electrophotographic processing.

[Intermediate Transfer Belt Unit and Photosensitive Drum Unit]

Figure 2:
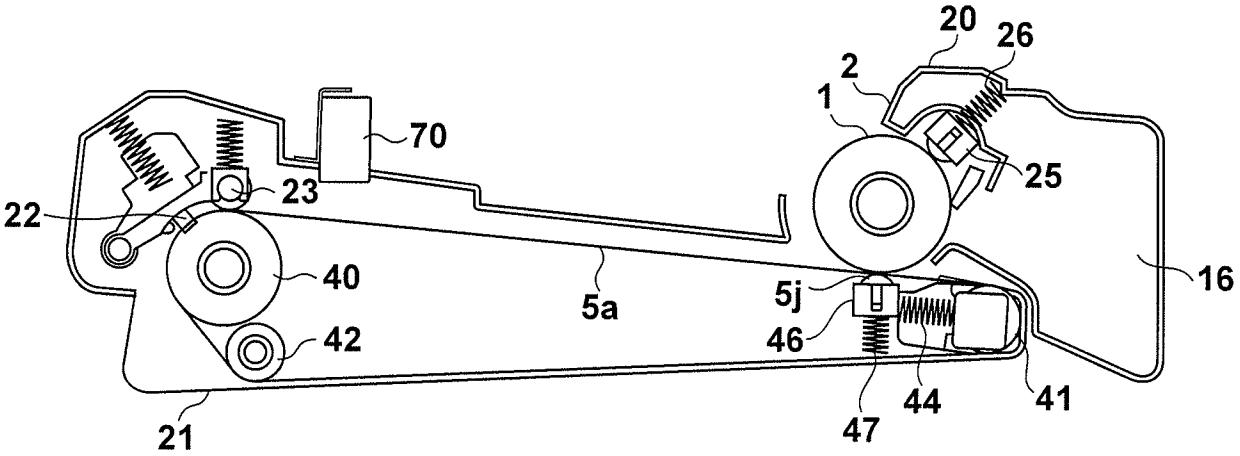
FIG. 2 is a diagram illustrating a main cross section of an intermediate transfer belt unit and a drum cartridge unit.
Figure 3:
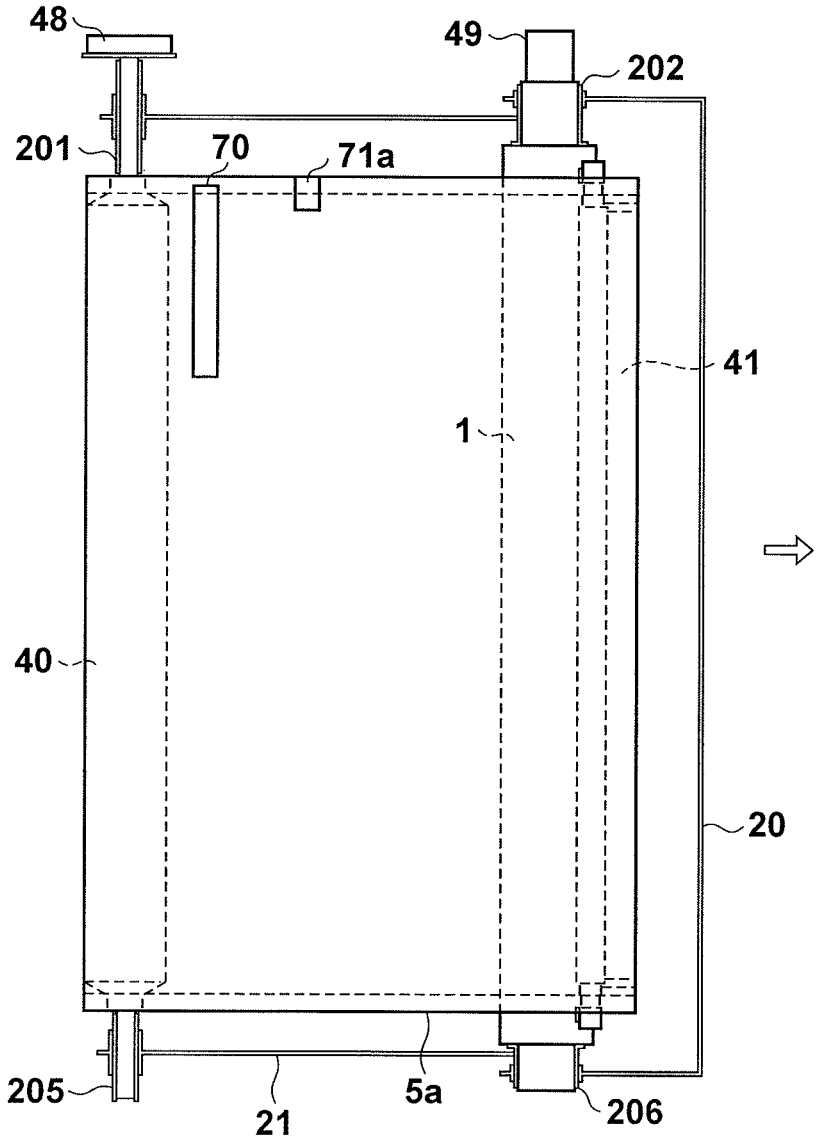
FIG. 3 is a diagram illustrating a transverse cross section of the intermediate transfer belt unit and the drum cartridge unit.

In an intermediate transfer belt unit 21 shown in FIGS. 2 and 3, a photosensitive drum unit 20 is disposed on the upper side of the intermediate transfer belt 5*a*. The photosensitive drum unit 20 includes the waste toner box 16. There is a limit to the length in the longitudinal direction of the recording medium in which the image forming apparatus 100 can perform image formation. That is, the largest size of the recording medium that can be used for image formation is decided when the image forming apparatus is designed. Here, the circumferential length of the intermediate transfer belt 5*a* is at least the length in the longitudinal direction of the recording medium of the largest size, and less than twice that length. For example, legal size or A4 size can be used as the largest size. Specifically, the intermediate transfer belt unit 21 is downsized such that it is impossible to simultaneously form two pages of A4 size image on the intermediate transfer belt 5*a*. In FIG. 2, the driving roller 40 is provided with the charging brush 22 and the charging roller 23 for applying electrical charge of opposite polarity to that applied at the time of transfer to the residual toner on the intermediate transfer belt 5*a*. As described above, the charging brush 22 and the charging roller 23 can contact and depart from the intermediate transfer belt 5*a*.

In FIG. 3, the photosensitive drum unit 20 rotatably holds both ends of the photosensitive drum 1 by a right side bearing 202 and a left side bearing 206. A predetermined rotation driving force is transmitted to the photosensitive drum 1 from the driving motor via a coupling 49 disposed at the right end portion of the photosensitive drum 1. The charging roller 2 is held by bearings 25 at the ends, and is pressed against the photosensitive drum 1 by a predetermined force due to a compressed spring 26. Accordingly, the charging roller 2 is rotated by the photosensitive drum 1.

In FIG. 3, the ends of the driving roller 40 of the intermediate transfer belt unit 21 are rotatably held by a right side bearing 201 and a left side bearing 205. A predetermined rotation driving force is transmitted to the driving roller 40 from the driving motor via a driving gear 48. In FIG. 2, compressed springs 44 are provided to bearings at the ends of the first driven roller 41 so as to apply a predetermined tension to the intermediate transfer belt 5*a*. At the position opposing the photosensitive drum 1 with the intermediate transfer belt 5*a* disposed therebetween, the primary transfer roller 5*j* is provided. Compressed springs 47 are respectively attached to bearings 46 at the ends of the primary transfer roller 5*j*. The primary transfer roller 5*j* is pressed against the intermediate transfer belt 5*a* by the compressed spring 47 by a predetermined force. Accordingly, the primary transfer roller 5*j* is rotated by the intermediate transfer belt 5*a*. At least one of the bearings 46 is formed by an electrically conductive member. Therefore, by applying a predetermined bias to the primary transfer roller 5*j* via the bearings 46, the toner on the surface of the photosensitive drum 1 can be primary-transferred onto the intermediate transfer belt 5*a*.

As described with reference to FIG. 1, the markers 71*a* and 71*b* that are optical reflecting members are attached to an area outside the image formation region in the width direction of the intermediate transfer belt 5*a*. In FIG. 3, a reflection type optical sensor 70 is disposed at a predetermined position opposed to the markers 71*a* and 71*b*. By the optical sensor 70 detecting the reflection light from the markers 71*a* and 71*b*, the position of the intermediate transfer belt 5*a* in the transport direction and the image writing start timing are determined. Synchronized with a detection signal (ITB_TOP) output from the optical sensor 70, the exposure device 3 controls exposure timing of a light beam onto the photosensitive drum 1.

[System of Image Forming Apparatus]

Figure 4:
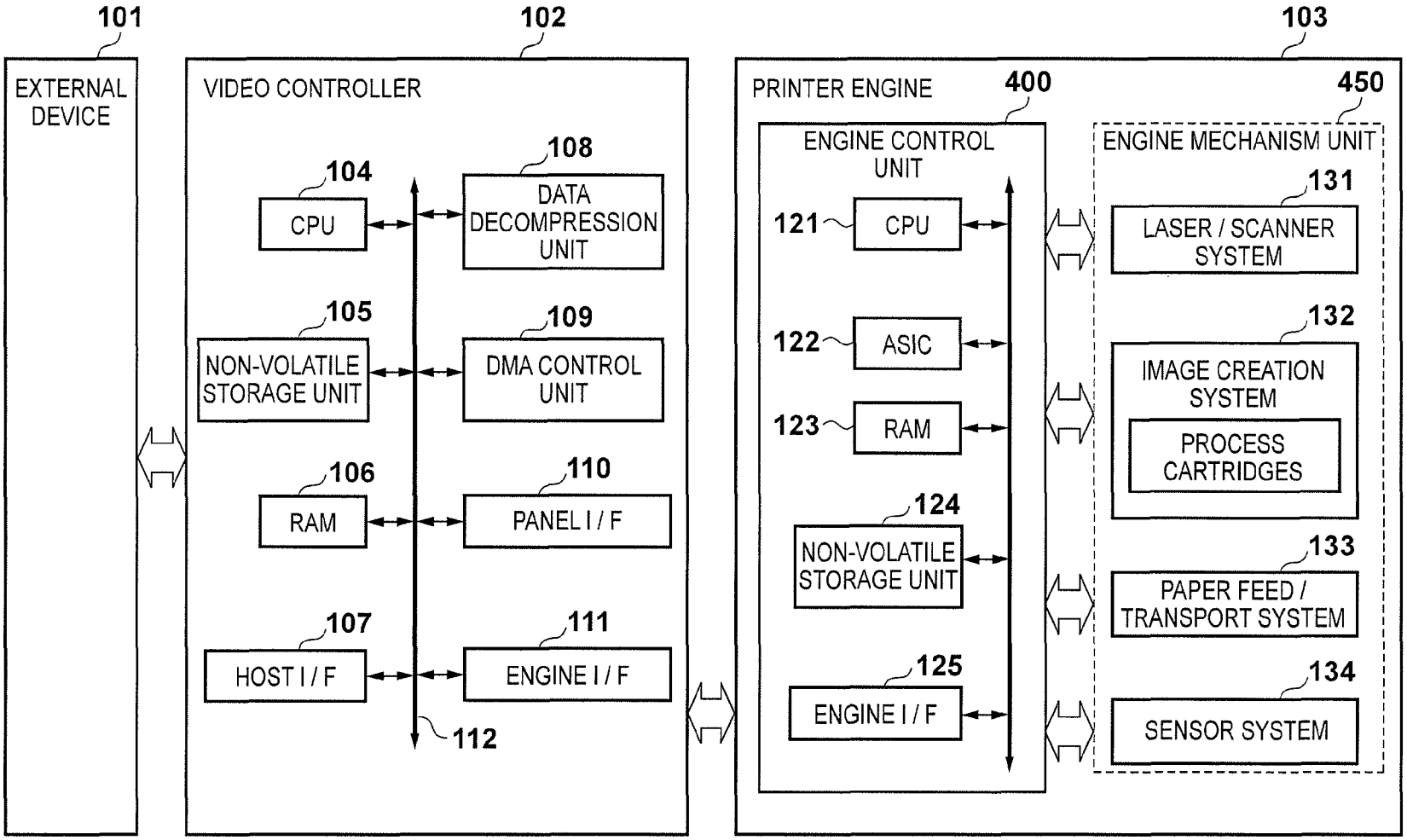
FIG. 4 is a block diagram illustrating hardware of the image forming apparatus.

A control unit of the image forming apparatus is described with reference to FIG. 4. The control unit is roughly divided into a video controller 102 that communicates with an external device 101 and a printer engine 103. In the video controller 102, reference numeral 104 denotes a CPU that controls the entire video controller 102. Reference numeral 105 denotes a non-volatile storage unit that stores various control codes executed by the CPU 104. The non-volatile storage unit 105 corresponds to a storage device such as a ROM, EEPROM, or hard disk drive, for example. Reference numeral 106 denotes a RAM for temporary storage that functions as a main memory or a work area of the CPU 104. Reference numeral 107 denotes a host interface for receiving print data or control data from the external device 101 such as a host computer, and outputting control information. The print data received by the host interface 107 is stored in the RAM 106 as compressed data. A data decompression unit 108 decompresses arbitrary compressed data stored in the RAM 106 to image data in line units. In addition, decompressed image data is stored in the RAM 106. A DMA control unit 109 transfers image data in the RAM 106 to an engine interface 111 in response to an instruction from the CPU 104. The DMA control unit 109 sometimes transfers arbitrary compressed data in the RAM 106 to the data decompression unit 108. Furthermore, the DMA control unit 109 sometimes transfers image data output from the data decompression unit 108 to the engine interface 111. Reference numeral 110 is a panel interface for receiving various settings or instructions input by an operator from a panel unit provided in the printer main body. Reference numeral 111 denotes an engine interface serving as a unit for inputting and outputting signals from and to the printer engine 103. The engine interface 111 sends out data signals from an output buffer register not shown in the drawings and controls communication with the printer engine 103. Reference numeral 112 denotes a system bus including an address bus and a data bus. The above-described elements are connected to the system bus 112, and can access each other.

Roughly divided, the printer engine 103 is configured by an engine control unit 400 and an engine mechanism unit 450. The engine mechanism unit 450 operates according to various instructions from the engine control unit 400. A laser/scanner system 131 is part of the exposure device 3, and includes a laser light-emitting element, a laser driver circuit, a scanner motor, a rotary polygon mirror, a scanner driver and the like. When the laser/scanner system 131 receives an exposure starting instruction signal (TOP_ENB) sent by a CPU 121, the laser/scanner system 131 exposures and scans the photosensitive drum 1 with a laser beam according to the image data sent from the video controller 102. An image creation system 132 causes a toner image based on a latent image formed on the photosensitive drum 1 to be formed on the recording medium. The image creation system 132 includes the photosensitive drum unit 20, the rotary developing apparatus 4, cartridges such as developing devices 4Y to 4Bk, the intermediate transfer belt 5*a*, the fixing device 8 and a high voltage power supply circuit for generating various biases (high voltages) for image creation. The photosensitive drum unit 20 includes the charging roller 2, the photosensitive drum 1 and the like. Also, the image creation system 132 includes motors, motor drivers and the like not shown in the drawings for driving the rotary developing apparatus 4, the intermediate transfer belt 5*a*, driving roller 40 or a fixing device. The process cartridge includes a non-volatile memory tag. The CPU 121 or an ASIC 122 performs reading and writing of various information on the memory tag. A paper feed/transport system 133 is configured by the pickup roller 18, the transport rollers 7*d* and motors for driving these. Also, the paper feed/transport system 133 stops the driving motor according to a stop instruction from the CPU 121, thereby rotating the rotary developing apparatus 4, or stopping the intermediate transfer belt 5*a*. A sensor system 134 is a sensor group for collecting information necessary for the CPU 121 and the ASIC 122 to control the laser/scanner system 131, the image creation system 132 and the paper feed/transport system 133. The sensor system 134 includes a temperature sensor of the fixing device 8, a toner remaining amount detection sensor, a density sensor for detecting image density, a sensor for detecting the sheet size, a sensor for detecting the leading edge of the sheet, a sensor for detecting sheet transportation, and the like. The information detected by these sensors is obtained by the CPU 121, and reflected in print sequence control. In particular, the sensor system 134 includes the rotary position detection sensor 11 and the optical sensor 70.

In the engine control unit 400, the CPU 121 uses a RAM 123 as a main memory or a work area, and controls the engine mechanism unit 450 according to various control programs stored in a non-volatile storage unit 124. More specifically, the CPU 121 drives the laser/scanner system 131 based on print control commands and image data that are input from the video controller 102 via the engine interface 111 and an engine interface 125. Also, the CPU 121 controls the image creation system 132 and the paper feed/transport system 133, thereby controlling various print sequences. Also, the CPU 121 drives the sensor system 134, thereby acquiring information necessary for controlling the image creation system 132 and the paper feed/transport system 133. The ASIC 122 performs control of various motors for executing various print sequences, or high voltage power supply control of the developing bias or the like, according to instructions from the CPU 121. Note that part or all of the functions of the CPU 121 may be performed by the ASIC 122. Conversely, part or all of the functions of the ASIC 122 may be performed by the CPU 121. Also, by separately providing dedicated hardware for part of the functions of the CPU 121 or the ASIC 122, the dedicate hardware may perform the part of the functions.

[Positional Alignment of Toner Images of Respective Colors in Multi-Color Image in First Rotary Position (FIG. 1)]

The rotary developing apparatus 4 rotates and disposes itself at various stop positions in 360°. The stop position may be referred to as a standby position or a rotation position, or a rotary position, or may be simply referred as a position. The mechanical shock or load applied to the intermediate transfer belt 5*a* may vary according to the rotary position. Accordingly, it is necessary to adjust the image-writing start timing according to the rotary position.

There are tandem type and rotary type in multi-color image forming apparatuses. In the rotary type image forming apparatus as shown in FIG. 1, an effect by the mechanical shock changes depending on the rotary position of the rotary developing apparatus. Accordingly, in the embodiments described below, the formation positions of the toner images to be primary-transferred onto the intermediate transfer belt 5*a* is corrected by correcting the image-writing start timing according to the rotary position.

Positional alignment of the images will be described below for each of a plurality of rotary positions. Before a print job is input, the rotary developing apparatus 4 is positioned at a first rotary position shown in FIG. 1. The first rotary position refers to a stop position in which the photosensitive drum 1 is disposed between a developing device 4Bk for black and a developing device 4C for cyan. That is, the first rotary position is a first stop position in which the image bearing member is located between a third developing device that performs development of the third color and a fourth developing device that performs development of the fourth color, among the plurality of developing devices.

Figure 5:
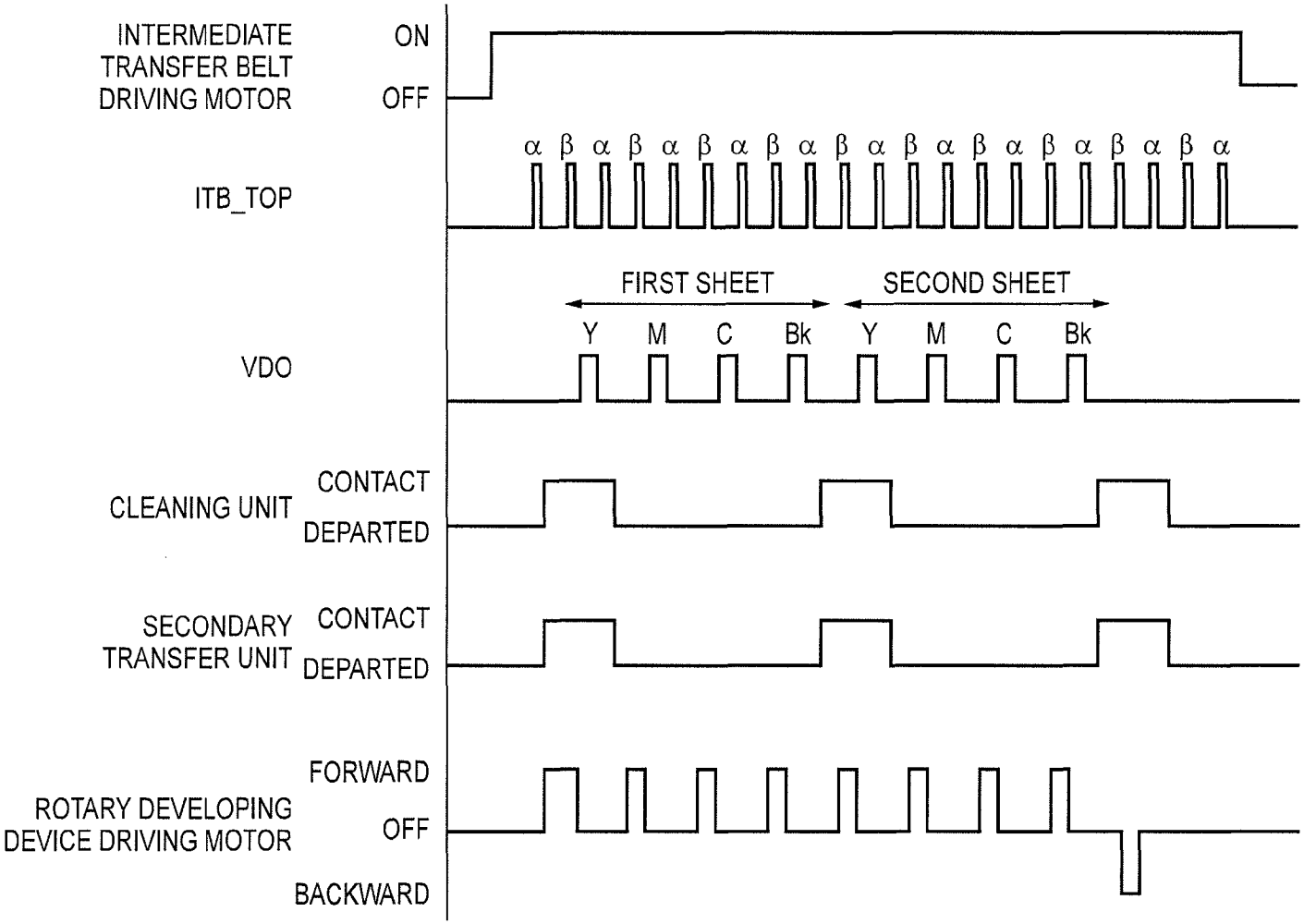
FIG. 5 is a timing chart illustrating the sequence for forming a multi-color image.

FIG. 5 shows ON/OFF of the driving motor for driving the intermediate transfer belt 5*a*, ITB_TOP, video signal input to the exposure device 3 (VDO), contact and departure of the charging brush 22 serving as the cleaning unit, contact and departure of the secondary transfer roller 12, and the rotation state of the driving motor for driving the rotary developing apparatus 4. Specifically, FIG. 5 shows timing charts of these when a multi-color image is formed. In FIG. 5, when a job is input from the video controller 102, the CPU 121 turns on the driving motor for driving the intermediate transfer belt 5*a*, and when image formation is finished, turns off the driving motor. The optical sensor 70 outputs a pulsed detection signal (ITB_TOP) indicating detection of the markers 71*a* or 71*b* every time the marker 71*a* or 71*b* is detected. In FIG. 5, α corresponds to the pulse corresponding to the marker 71*a*, and β corresponds to the pulse corresponding to the marker 71*b*. Note that the marker that is first detected after the intermediate transfer belt 5*a* is activated is referred to as the marker 71*a*.

The CPU 121 controls, by using ITB_TOP as a reference, output timing of VDO to the exposure device 3 (timing for starting to write an electrostatic latent image). The CPU 121 causes the charging brush 22 to contact or depart from the intermediate transfer belt 5*a*, synchronized with the timing shown in FIG. 5. Note that the CPU 121 causes the secondary transfer roller 12 to contact and depart from the intermediate transfer belt 5*a* at the same contact and departure timings as those of the charging brush 22. The driving motor for driving the rotary developing apparatus 4 shown in FIG. 5 performs four forward rotations per recording sheet, such that the developing device to be used for development reaches the development position. Note that when the job is finished, the CPU 121 rotates the driving motor in reverse, thereby rotating the rotary developing apparatus 4 to the stop position.

Figure 6:
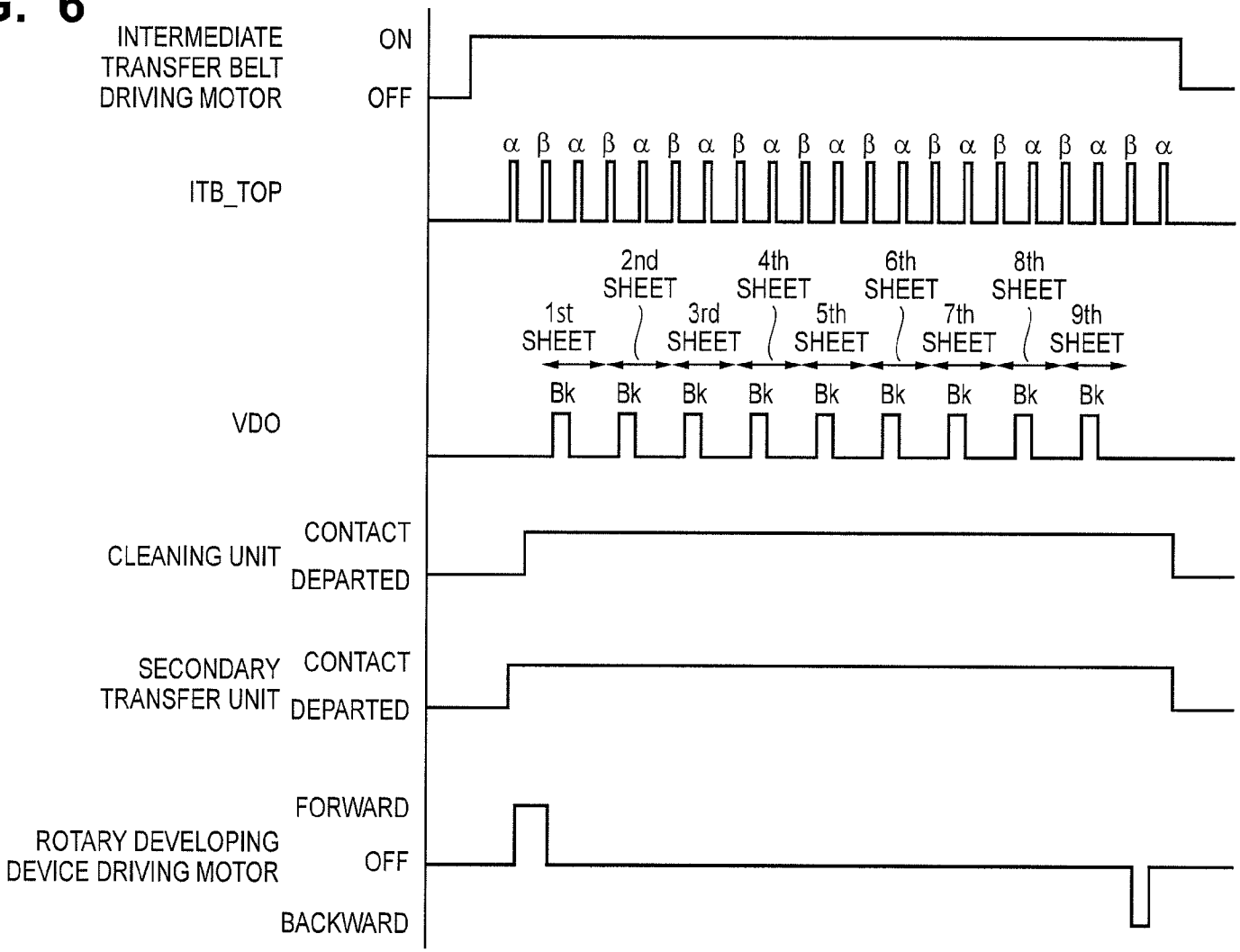
FIG. 6 is a timing chart illustrating the sequence for forming a single-color image.

FIG. 6 shows the timing chart when a single-color image is formed. As understood by comparing FIG. 6 with FIG. 5, during execution of a job, the charging brush 22 and the secondary transfer roller 12 each perform contact and departure only one time. This is because superposing transfer of a plurality of colors is not necessary for forming a single-color image. Also, forward rotation and inverse rotation of the rotary developing apparatus 4 are each performed only one time.

Figure 7:
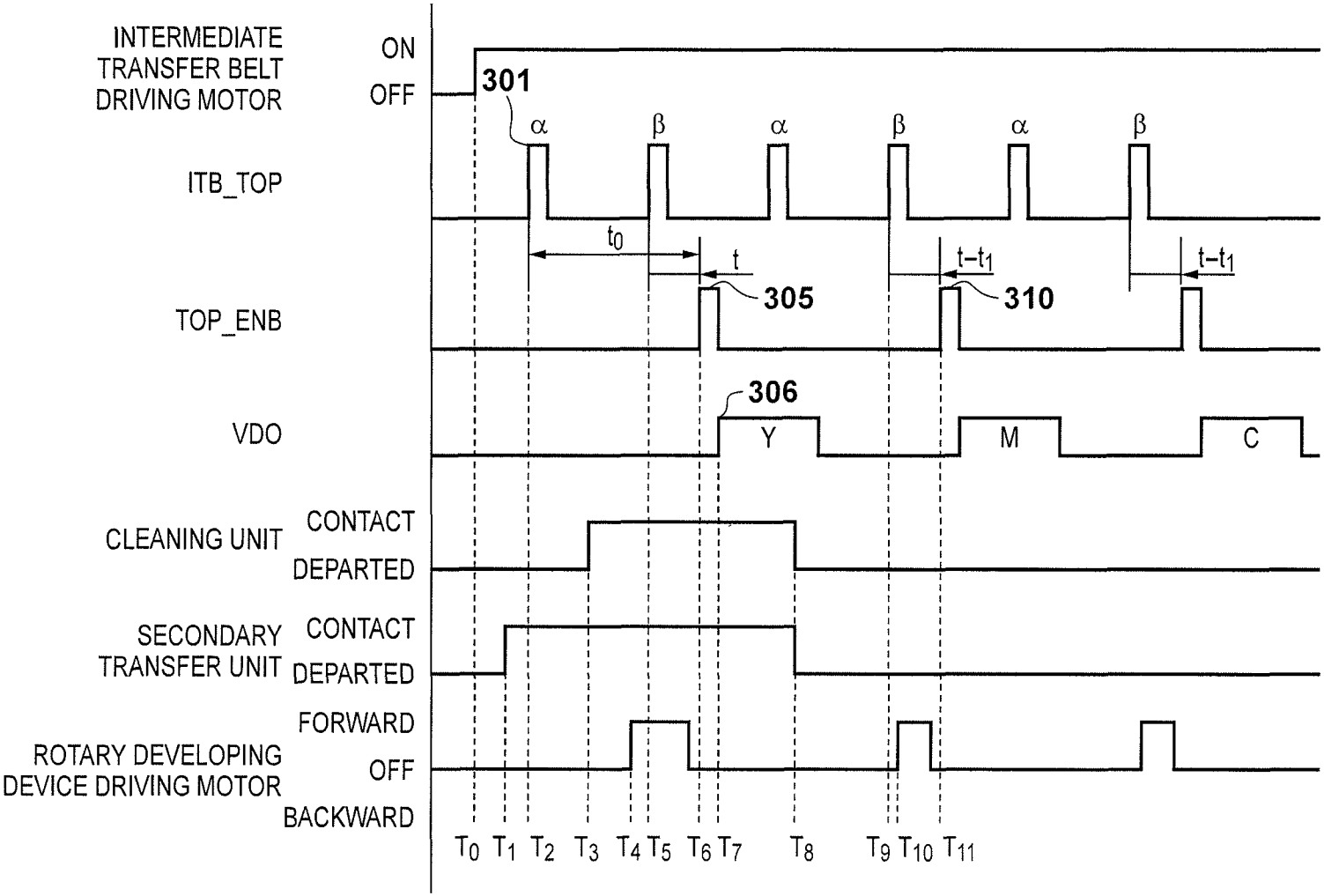
FIG. 7 is a timing chart illustrating the color misalignment correction sequence for a first rotary position.

A method for adjusting the writing start timing will be described in detail with reference to FIG. 7. Here, it is assumed that toner images of a plurality of colors are formed. Also, the CPU 121 manages the sequence by using a counter. A timer may be used instead of the counter.

First, the CPU 121 identifies the rotary position of the rotary developing apparatus 4 based on the signal output from the rotary position detection sensor 11. The CPU 121 stores information indicating the identified rotary position in the RAM 123. The rotary position detection sensor 11 functions as a stop position detection unit that detects the stop position at which the intermediate transfer member has been stopped before starting rotation, out of the stop positions of the intermediate transfer member.

At the point in time $T_0$, the CPU 121 starts the counter when the driving roller 40 starts rotating the intermediate transfer belt 5*a*. When the counter value reaches the point in time $T_1$, the CPU 121 causes the secondary transfer roller 12 to contact the intermediate transfer belt 5*a*, and measures the voltage when a certain current is applied to the secondary transfer roller 12, thereby detecting the resistance of the intermediate transfer belt 5*a*. When a current is applied to the secondary transfer roller 12 during actual image formation, the applied current value is varied depending on the environment or the type of recording sheet. The detected resistance value is used when the CPU 121 calculates the voltage of the secondary transfer bias to be applied. At the point in time $T_2$, the optical sensor 70 detects the marker 71*a*, and outputs a first ITB_TOP signal 301. The marker 71*a* is an example of a first marker that is first detected by a marker detecting unit after the rotation of the intermediate transfer member is started. The marker 71*b* is an example of a second marker that is detected next to the first marker by the marker detecting unit after the rotation of the intermediate transfer member is started.

CPU 121 acquires the point in time $T_2$ from the counter and stores the data in the RAM 123. The position on the peripheral face of the intermediate transfer belt 5*a* is determined by detecting the marker 71*a*. By executing subsequent image forming processes by using the point in time $T_2$ stored in the RAM 123 as a reference, the start-up time of the engine mechanism unit 450 can be reduced. Also, by using the timing at which the marker 71*a* is detected as a reference, the CPU 121 can determine the timing for causing the secondary transfer roller 12, the charging brush 22 or the like to contact the intermediate transfer belt 5*a*. The charging brush 22 is an example of a cleaning member that cleans the intermediate transfer member. The secondary transfer roller 12 is an example of a secondary transfer member for performing secondary transfer of a toner image from the intermediate transfer member. The CPU 121 adds a predetermined time to the point in time $T_2$, thereby determining the point in time $T_3$ and the point in time $T_4$. When the CPU 121 has confirmed that the counter value has reached the point in time $T_3$, it causes the charging brush 22 constituting the cleaning unit to contact the intermediate transfer belt 5*a*, thereby performing a preparation operation for image formation. When the CPU 121 has confirmed that the counter value has reached the point in time $T_4$, it activates the driving motor to rotate the rotary developing apparatus 4, and moves the yellow developing device 4Y to the development position. This moving of the developing device is also included in the preparation operation for image formation.

When part of the preparation operation (contact by the cleaning unit) is finished, the CPU 121 detects the marker 71*b* by the optical sensor 70. Then, the CPU 121 sets the counter value at the time of the detection as a Y writing start reference point in time $T_5$, and stores the reference point in time $T_5$ in the RAM 123. Thereafter, at the point in time $T_6$ at which a Y exposure standby period $t_0$ has elapsed from the reference point in time $T_2$, the CPU 121 outputs a TOP_ENB signal 305 to the exposure device 3. The exposure device 3 starts exposure processing upon detecting the TOP_ENB signal 305. In this manner, the exposure device 3 is an example of an exposure unit that exposes the image bearing member by using, as a reference, the timing at which the first marker out of a plurality of markers is detected by the marker detecting unit for the toner image of the first color. Note that the Y exposure standby period $t_0$ is set in advance so as to be longer than the period until a Y writing start reference point in time $T_5$.

The CPU 121 measures by using the counter a time from the Y writing start reference point in time $T_5$ to the point in time $T_6$ at which the CPU 121 starts outputting the TOP_ENB signal 305, and stores the measured time in the RAM 123 as an exposure synchronization time t. The exposure synchronization time t is used for determining the writing start timing for magenta, cyan and black. In this manner, the CPU 121, the counter and the RAM 123 are an example of a recording unit for recording the time from the timing at which the second marker is detected to the timing at which the exposure unit starts exposure for forming the toner image for the first color of a plurality of colors.

When the CPU 121 has confirmed that the writing point in time $T_7$ for yellow VDO, which is determined by using the TOP_ENB signal 305 as the reference point, has reached, the engine interface 125 outputs a VDO signal 306 for yellow. By the VDO signal 306, the engine mechanism unit 450 starts image formation. That is, a yellow toner image is formed on the photosensitive drum 1, and primary-transferred to the intermediate transfer belt 5*a*. When the CPU 121 has detected the marker 71*a* again, the processing moves to the image forming process for the next color, magenta. At the predetermined point in time $T_8$ during the period from detection of the marker 71*a* to detection of the marker 71*b*, the CPU 121 causes the secondary transfer roller 12, the charging brush 22 and the charging roller 23 to depart from the intermediate transfer belt 5*a*. Accordingly, it is possible to prevent the secondary transfer roller 12 and the like from contacting the yellow toner image on the intermediate transfer belt 5*a*. The CPU 121 outputs a TOP_ENB signal 310 for magenta to the exposure device 3 at the point in time $T_{11}$, which is the point in time when a corrected exposure time $t-t_1$ has elapsed from the point in time $T_9$ at which the marker 71*b* has been detected. The exposure device 3 starts exposure processing upon detecting the TOP_ENB signal 310. In this manner, the exposure device 3 is an example of an exposure unit that exposes an image bearing member by using the timing at which the second marker out of a plurality of markers is detected by the marker detecting unit as a reference, with respect to toner images for the second and subsequent colors.

Note that the CPU 121 determines the corrected exposure time $t-t_1$ by subtracting a correction value $t_1$ from the exposure synchronization time t stored in the RAM 123. In this manner, the CPU 121 is an example of an exposure timing control unit that determines the exposure timing for forming toner images for the second and subsequent colors of the toner images of a plurality of colors while reflecting measured time. The correction value $t_1$ is a correction value corresponding to the first rotary position shown in FIG. 1. The non-volatile storage unit 124 stores correction values corresponding to various rotary positions. The correction values may be determined by tests or simulations when the apparatus is shipped from a factory. In this manner, the CPU 121 sets a correction value that is for correcting the exposure timing of the exposure unit, and corresponds to the stop position of the rotary developing apparatus 4. The non-volatile storage unit 124 functions as a correction value holding unit that holds correction values respectively corresponding to the plurality of stop positions of the intermediate transfer member. Also, the CPU 121 functions as a correction value determination unit that determines a correction value corresponding to the stop position detected by the stop position detection unit, by reading out the correction value from the correction value holding unit. The superposing positions of the images of four colors are aligned by setting, also for cyan and black, similar to magenta, the point in time at which a time period t−t1 has elapsed from the time when the marker 71*b* has been detected as the writing start timing.

In this manner, in the foregoing embodiment, contact by the cleaning member and the intermediate transfer member is made in a time period from the timing at which the first marker is detected until the timing at which the second marker is detected. Specifically, the writing start timing can be set in the period in which the mechanical shock due to the contact by the charging brush 22, the charging roller 23 and the like is not present (exposure synchronization time t). Since the intermediate transfer belt 5*a* runs comparatively stably in a period in which a mechanical shock does not occur, color misalignment due to fluctuation in the circumferential speed of the intermediate transfer belt 5*a* is mitigated.

[Positional Alignment of Toner Images of Respective Colors of Multi-Color Image in Second Rotary Position (FIG. 8)]

Figure 8:
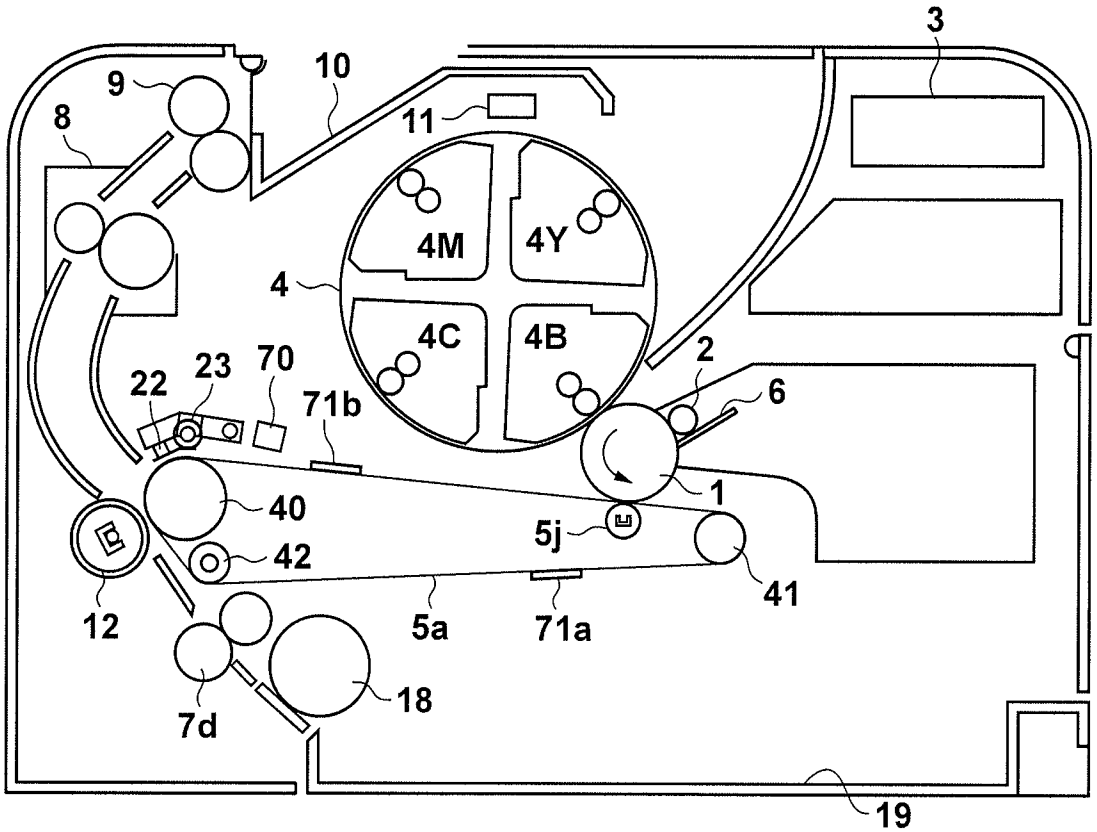
FIG. 8 is a diagram illustrating a second rotary position.
Figure 9:
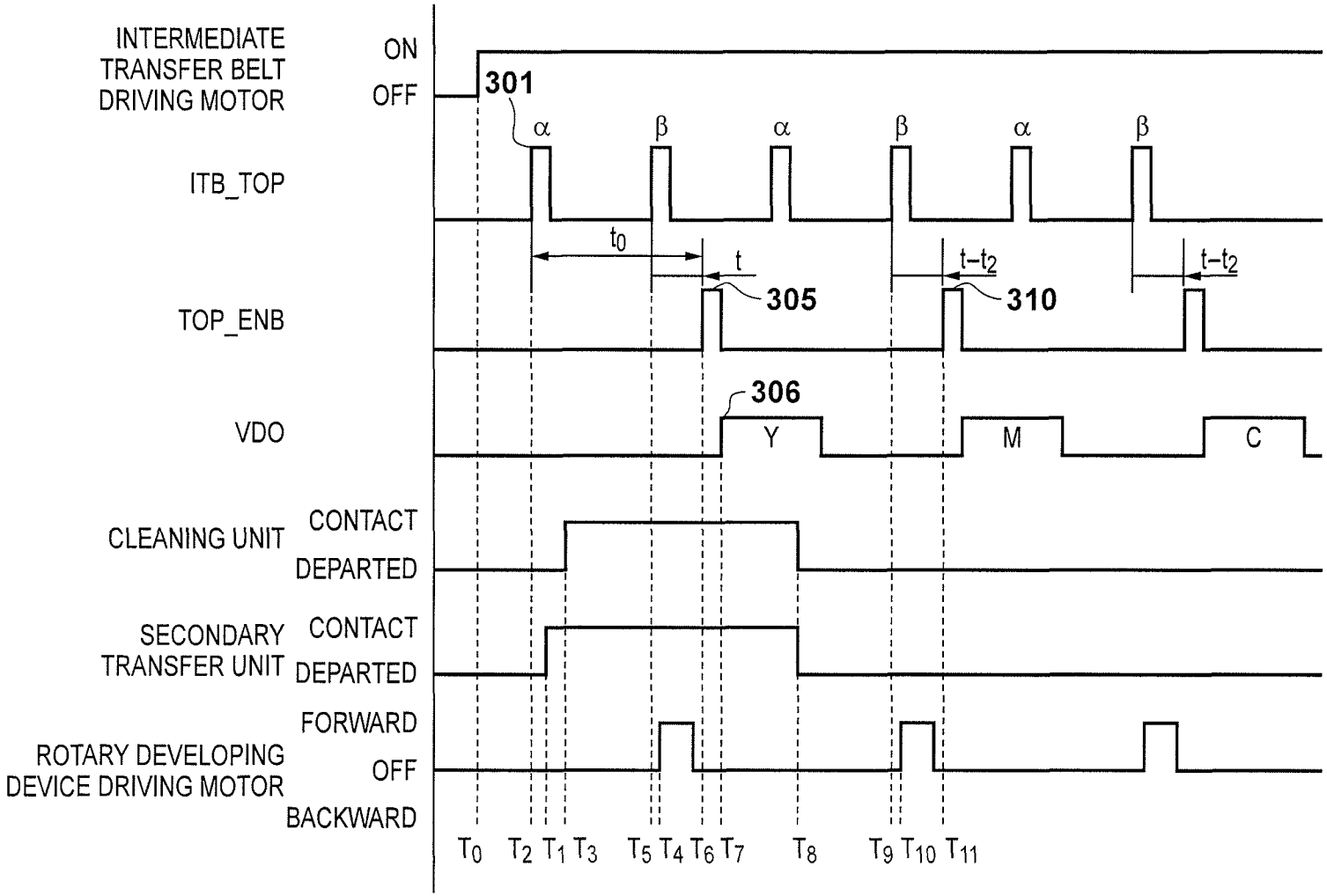
FIG. 9 is a timing chart illustrating the color misalignment correction sequence for the second rotary position.

FIG. 8 shows a state in which the rotary developing apparatus 4 is positioned at the second rotary position. That is, the second rotary position is a stop position of the rotary developing apparatus 4 in which the developing device 4Bk for black is in contact with the photosensitive drum 1. In other words, the second rotary position is a second stop position in which a fourth developing device that performs development of the fourth color of a plurality of developing devices is in contact with the image bearing member. Stopping at the second rotary position occurs, for example, when a job for the first sheet is finished and processing is moving to a job for the second sheet. The CPU 121 identifies the rotary position of the rotary developing apparatus 4 based on the signal output from the rotary position detection sensor 11. Accordingly, it becomes possible for the CPU 121 to read out the correction value corresponding to the identified rotary position from the non-volatile storage unit 124. As described above, the CPU 121 measures the exposure synchronization time t and stores the same in the RAM 123, when image formation for yellow is executed. Therefore, as shown in FIG. 9, when image formation is performed for the colors subsequent to magenta, the CPU 121 calculates a corrected exposure time $t-t_2$ by subtracting a correction value $t_2$ corresponding to the second rotary position from the exposure synchronization time t. The CPU 121 outputs the TOP_ENB signal 310 for magenta to the exposure device 3 at the point in time $T_{11}$, which is the point in time when the corrected exposure time $t-t_2$ has elapsed from the point in time $T_9$ at which the marker 71*b* has been detected. Note that the value of $t_2$ is smaller than the value of $t_1$.

Here, the reason for performing correction is described. In the second rotary position, compared with the first rotary position (FIG. 1), the number of contacts until the yellow developing device 4Y reaches the development position is reduced by one, which corresponds to the contact between the photosensitive drum 1 and the developing device 4Bk for black. Reduction of the number of contacts by one means that fluctuation in load due to the developing device-side development coupling and the main unit-side development coupling connecting to each other is reduced by one time. Therefore, the intermediate transfer belt 5*a* moves relatively fast, and thus the writing start position for yellow has moved relatively forward. This is why the writing start position for yellow has moved relatively forward. In view of this, for the colors subsequent to magenta, it is necessary to move the writing start positions forward for the colors subsequent to magenta by subtracting the correction value $t_2$ from the exposure synchronization time t. As a result, the image formation position of the first color yellow and the image formation positions of the second and subsequent colors are aligned. Note that at the second rotary position, the number of fluctuations in load is reduced by one compared with the first rotary position, and thus the distance that the writing start position for yellow moves forward is increased. Therefore, the value of $t_2$ is smaller than the value of $t_1$.

[Positional Alignment of Toner Images of Respective Colors of Multi-Color Image in Third Rotary Position (FIG. 10)]

Figure 10:
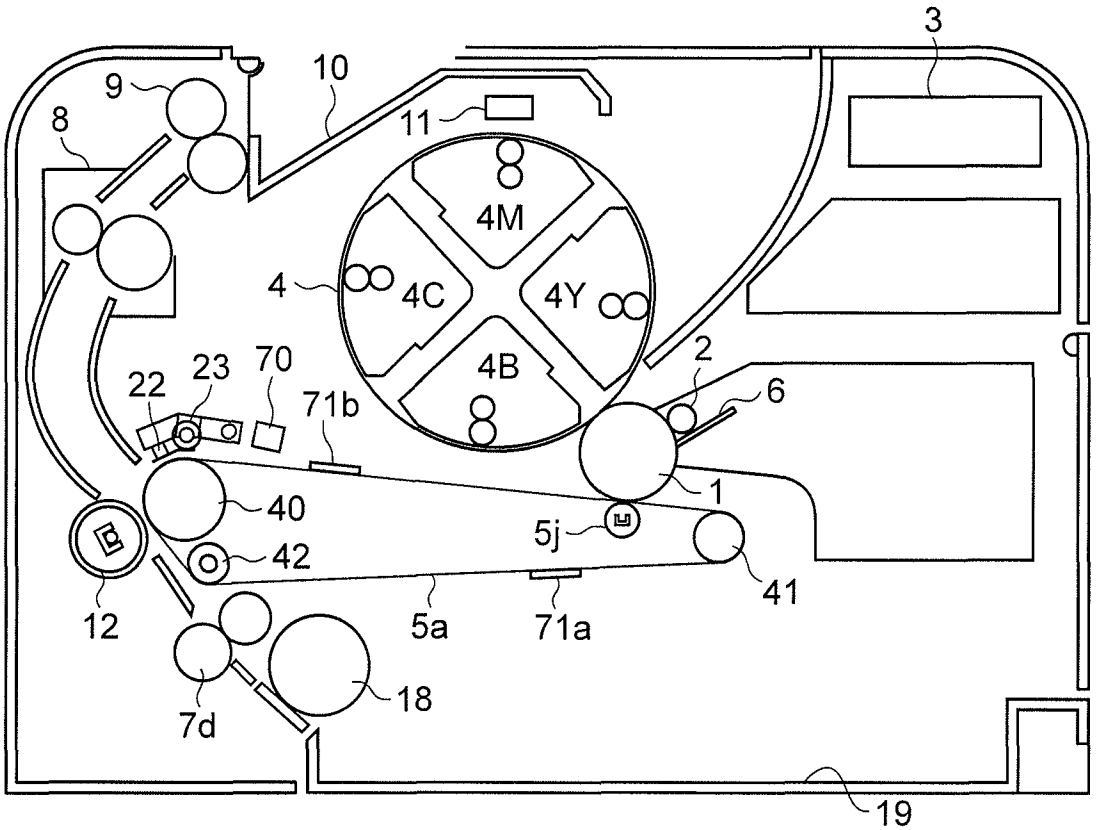
FIG. 10 is a diagram illustrating a third rotary position.

Correction of the writing start timing for the third rotary position is described. As shown in FIG. 10, the third rotary position is a stop position in which the photosensitive drum 1 is disposed between the developing device 4Y for yellow and the developing device 4Bk for black. That is, the third rotary position is a third stop position in which the image bearing member is present between the fourth developing device that performs development for the fourth color and a first developing device that performs development for the first color, out of the plurality of developing devices. The third rotary position is a position that may occur when, after yellow toner is adhered onto the photosensitive drum 1, the intermediate transfer belt 5*a* is cleaned and the next job is input.

Figure 11:
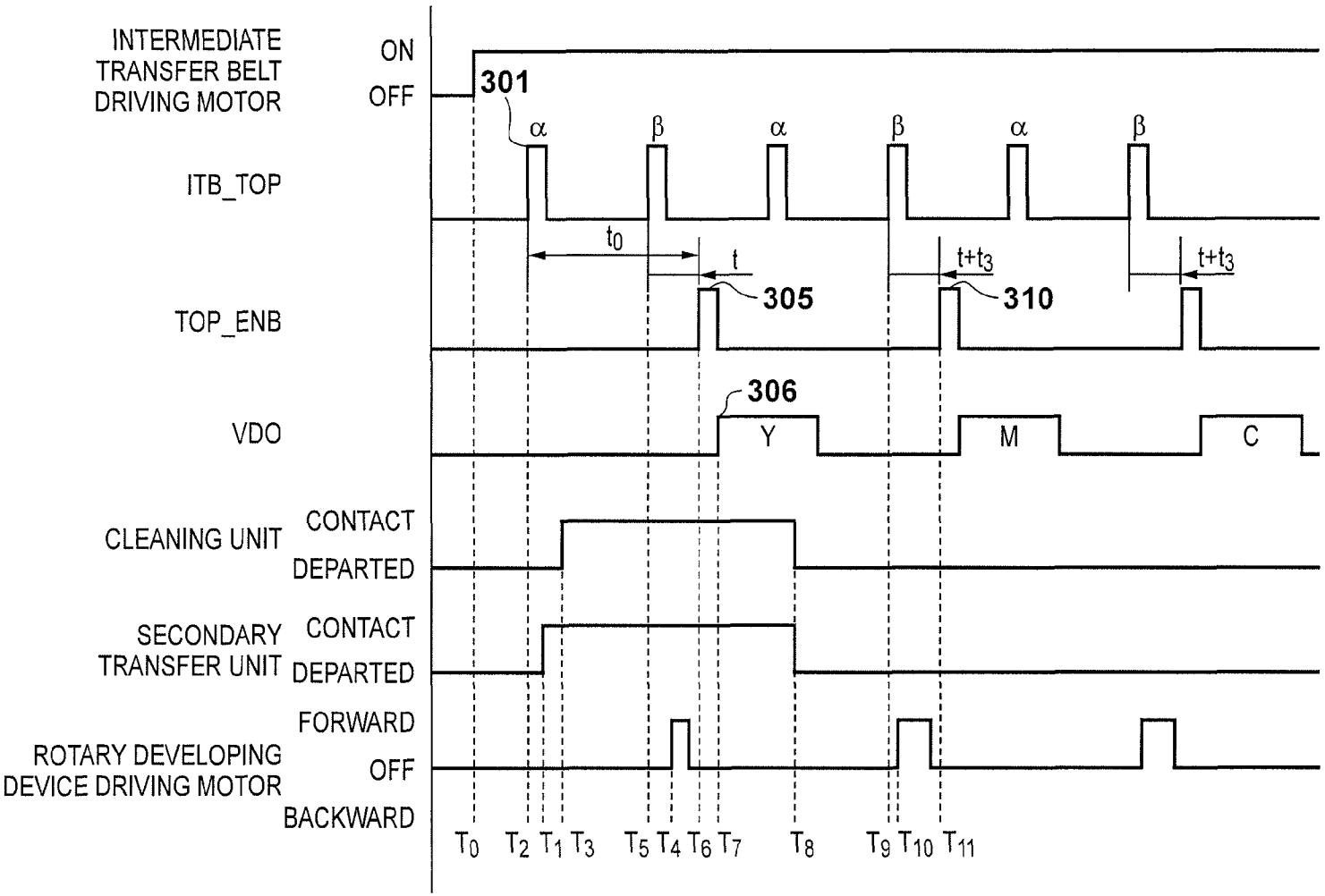
FIG. 11 is a timing chart illustrating the color misalignment correction sequence for the third rotary position.

Although in the first rotary position shown in FIG. 1, the exposure synchronization time t measured for yellow can be used for the other colors without change, in the third rotary position shown in FIG. 10, it is necessary to correct the exposure synchronization time t for the other colors. Accordingly, as shown in FIG. 11, the CPU 121 adds a correction value $t_3$ set for this purpose to the exposure synchronization time t, thereby correcting the writing start position. "$t+t_3$" is referred to as a corrected exposure time. The CPU 121 outputs the TOP_ENB signal 310 for magenta to the exposure device 3 at the point in time $T_{11}$, which is the point in time when the corrected exposure time $t+t_3$ has elapsed from the point in time $T_9$ at which the marker 71*b* has been detected.

Here, the reason for performing correction is described. In the state shown in FIG. 10, compared with the state of the rotary developing apparatus 4 shown in FIG. 8, the number of contacts and departures until the yellow developing device 4Y reaches the development position is each reduced by one time, which correspond to the contact and departure between the photosensitive drum 1 and the developing device 4Bk for black. Reduction of the number of contacts and departures each by one means that increase in load in rotation of the developing device due to the developing device-side development coupling and the main body-side development coupling connecting each other and increase in load due to the developing device-side development coupling and the main body-side development coupling separating from each other are each reduced by one time. In the present embodiment, the rotary developing apparatus 4 and the intermediate transfer belt 5*a* share the same driving source for rotating themselves, and an unexpected increase in load in rotation of the developing device leads to an unexpected increase in load to the entire driving source. There is a control limit in following such an unexpected increase in load, and the speed of the intermediate transfer belt 5*a* is momentarily reduced. That is, if the number of increases in load in rotation of the developing device is reduced by one for each of the connection and separation, the number of times of momentary reduction in speed decreases. As a result, compared with a case in which the number of times of unexpected increase in load is large, the intermediate transfer belt 5*a* moves relatively fast. Therefore, the writing start position for yellow has moved relatively forward. In view of this, for the colors subsequent to magenta, it is necessary to move the writing start position forward for the colors subsequent to magenta by adding the correction value $t_3$ from the exposure synchronization time t. As a result, the image formation position of the first color yellow and the image formation positions of the second and subsequent colors are aligned.

In this manner, since the load applied to the intermediate transfer belt 5*a* fluctuates depending on the stop position of the rotary developing apparatus 4 when image formation is started, the correction value $t_3$ may be switched according to the stop position. The correction value $t_3$ for each stop position may be determined by tests or simulations in advance, and may be stored in the non-volatile storage unit 124. The CPU 121 reads out the correction value $t_3$ corresponding to the stop position detected by the rotary position detection sensor 11 from the non-volatile storage unit 124 and uses the correction value $t_3$. In this manner, it is possible to reduce color misalignment caused by different rotary positions.

[Stop Processing of Intermediate Transfer Belt 5*a*]

Figure 12:
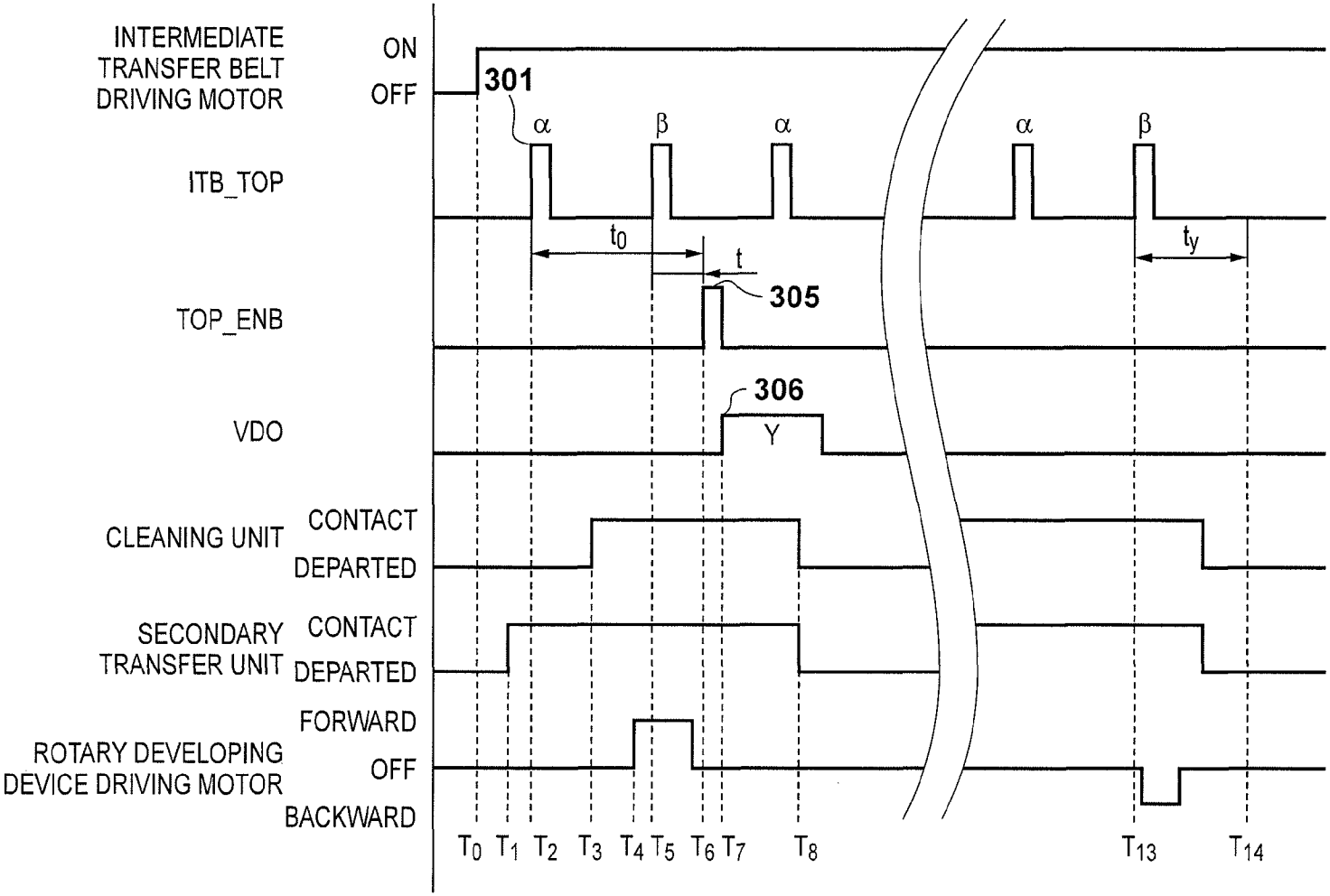
FIG. 12 is a timing chart illustrating an image formation ending operation.

According to FIG. 12, after the image forming process is finished, and preparations for stopping the intermediate transfer belt 5*a* are completed, the CPU 121 sets the point in time at which an ITB_TOP signal 311 is first detected as an end reference point in time $T_{13}$, and stores the end reference point in time $T_{13}$ in the RAM 123. The non-volatile storage unit 124 stores an end correction time $t_y$ that has been determined in advance when the apparatus is designed. The CPU 121 stops the driving motor that is driving the intermediate transfer belt 5*a* at the point in time $T_{14}$, which is the point in time when the end correction time $t_y$ has elapsed from the end reference point in time $T_{13}$. The end correction time $t_y$ is determined such that the ITB_TOP signal 301 is detected as soon as possible in the next image forming. When image formation is started, initial operations such as starting up the driving motor are necessary. Since the initial operation time is substantially constant, it is determined when the apparatus is designed. Also, the distance on the peripheral face between the marker 71*a* and the marker 71*b* is known. Therefore, the end correction time $t_y$ is determined based on the distance on the peripheral face and the initial operation time. In this manner, in the next time, the time period from start of image formation until detection of the marker 71*a* can be reduced.

Embodiment 2

Positional Alignment of Toner Images of Respective Colors in Multi-Color Image in First Rotary Position (FIG. 1)

Figure 13:
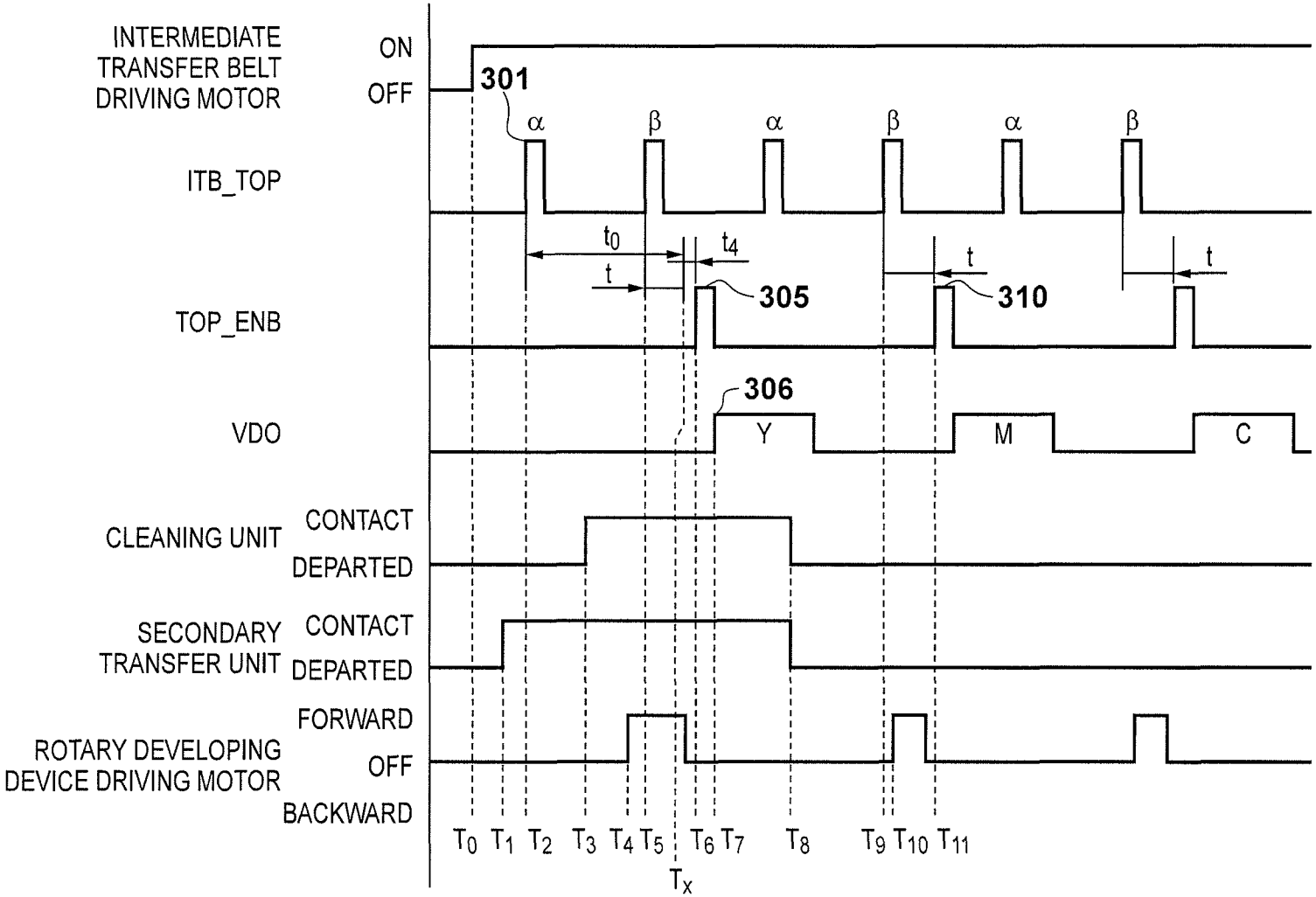
FIG. 13 is a timing chart illustrating the color misalignment correction sequence for the first rotary position.

In Embodiment 2, description of matters in common with Embodiment 1 will be omitted. In the embodiment shown in FIG. 7, the writing start position is not corrected for the first color yellow, and the writing start timings for the second and subsequent colors are corrected by subtracting the correction value $t_1$. On the other hand, as shown in FIG. 13, a similar correction results can be obtained by adding a correction value $t_4$ to the writing start timing for the first color. Note that in this case, the absolute value of the correction value $t_4$ is the same as that of the correction value $t_1$ described in FIG. 7. According to FIG. 13, the CPU 121 determines the timing obtained by adding the correction value $t_4$ corresponding to the second rotary position to the Y exposure standby period $t_0$ as the above-described point in time $T_6$. Then, the CPU 121 measures the time period from the point in time $T_5$ when the marker 71*b* is detected until the point in time $T_x$, and retains the measurement results in the RAM 123 as the exposure synchronization time t. The CPU 121 sets the point in time when the Y exposure standby period $t_0$ has elapsed from the point in time $T_2$ as the point in time T. The CPU 121 determines the writing start timings for the second and subsequent colors by using the exposure synchronization time t without change. That is, the CPU 121 starts outputting the TOP_ENB signal at the point in time $T_{11}$, which is the point in time when the exposure synchronization time t has elapsed from the point in time $T_9$ at which the marker 71*b* has been detected.

In this manner, a similar effect to the case in which the writing start timings for the second and subsequent colors are corrected is obtained also by correcting the writing start timing for the first color. Note that since the number of corrections is reduced, there is an advantage in reducing processing load on the CPU 121.

[Positional Alignment of Toner Images of Respective Colors in Multi-Color Image in Second Rotary Position (FIG. 8)]

In the embodiment shown in FIG. 9, the writing start position is not corrected for the first color yellow, and the writing start timings for the second and subsequent colors are corrected by subtracting the correction value $t_2$. On the other hand, as shown in FIG. 14, a similar correction result can be obtained by adding a correction value $t_5$ to the writing start timing for the first color.

Figure 14:
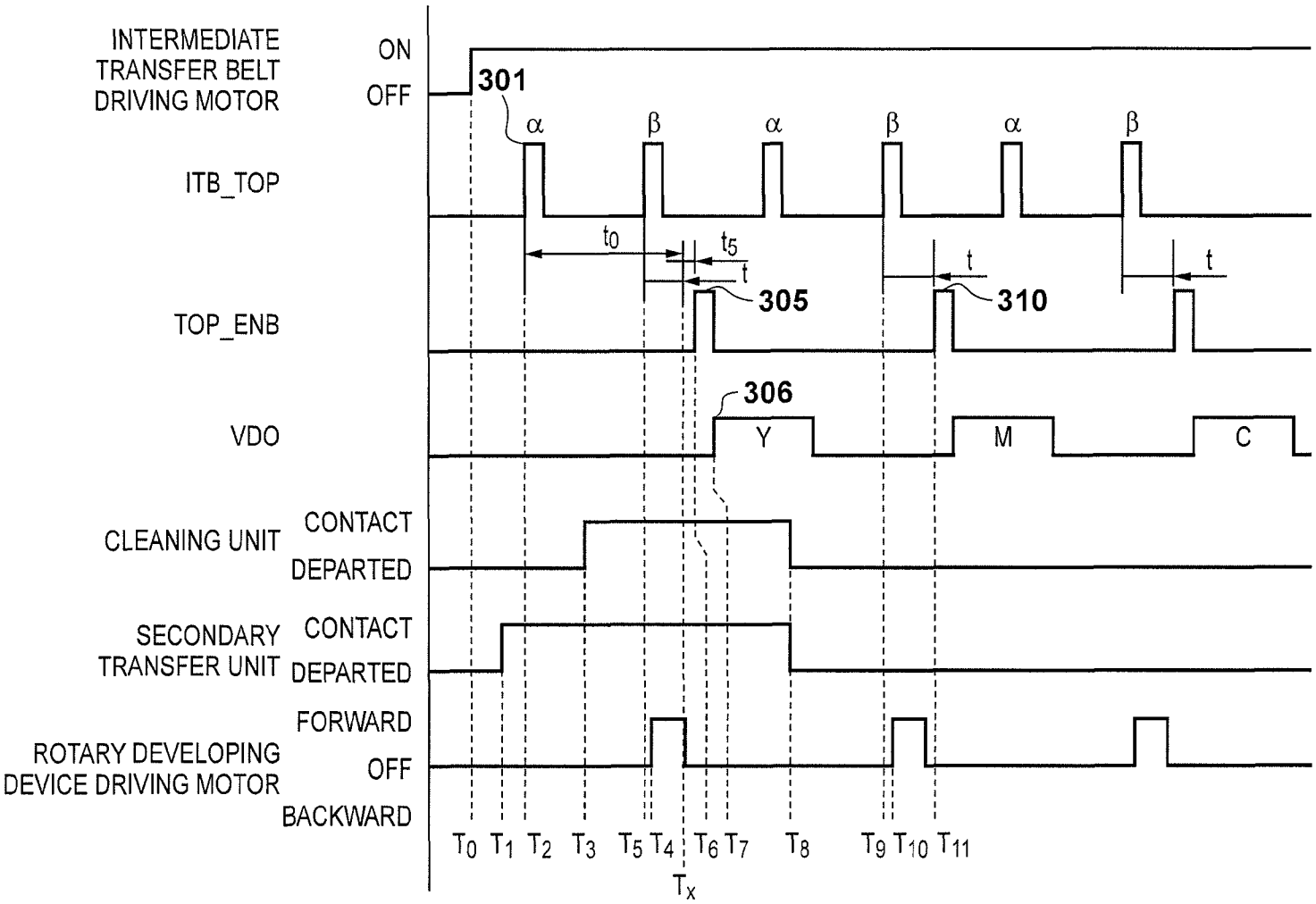
FIG. 14 is a timing chart illustrating the color misalignment correction sequence for the second rotary position.

According to FIG. 14, the CPU 121 determines the timing obtained by adding the correction value $t_5$ corresponding to the second rotary position to the Y exposure standby period $t_0$ as the above-described point in time $T_6$. The value of $t_5$ is smaller than the value of $t_4$. Then, the CPU 121 measures the time period from the point in time $T_5$ when the marker 71*b* is detected until the point in time $T_x$, and retains the measurement result in the RAM 123 as the exposure synchronization time t. The CPU 121 sets the point in time when the Y exposure standby period $t_0$ has elapsed from the point in time $T_2$ as the point in time T. The CPU 121 determines the writing start timings for the second and subsequent colors by using the exposure synchronization time t without change. That is, the CPU 121 starts outputting the TOP_ENB signal at the point in time $T_{11}$, which is the point in time when the exposure synchronization time t has elapsed from the point in time $T_9$ at which the marker 71*b* has been detected.

In this manner, a similar effect to the case in which the writing start timings for the second and subsequent colors are corrected is obtained also by correcting the writing start timing for the first color. Note that since the number of corrections is reduced, there is an advantage in reducing processing load on the CPU 121.

[Positional Alignment of Toner Images of Respective Colors in Multi-Color Image in Third Rotary Position (FIG. 10)]

Another correcting method for the third rotary position will be described. In the embodiment shown in FIG. 11, the writing start position is not corrected for the first color yellow, and the writing start timings for the second and subsequent colors are corrected by adding the correction value $t_3$. On the other hand, a similar correction result can be obtained by subtracting a correction value $t_6$ from the writing start timing for the first color.

Figure 15:
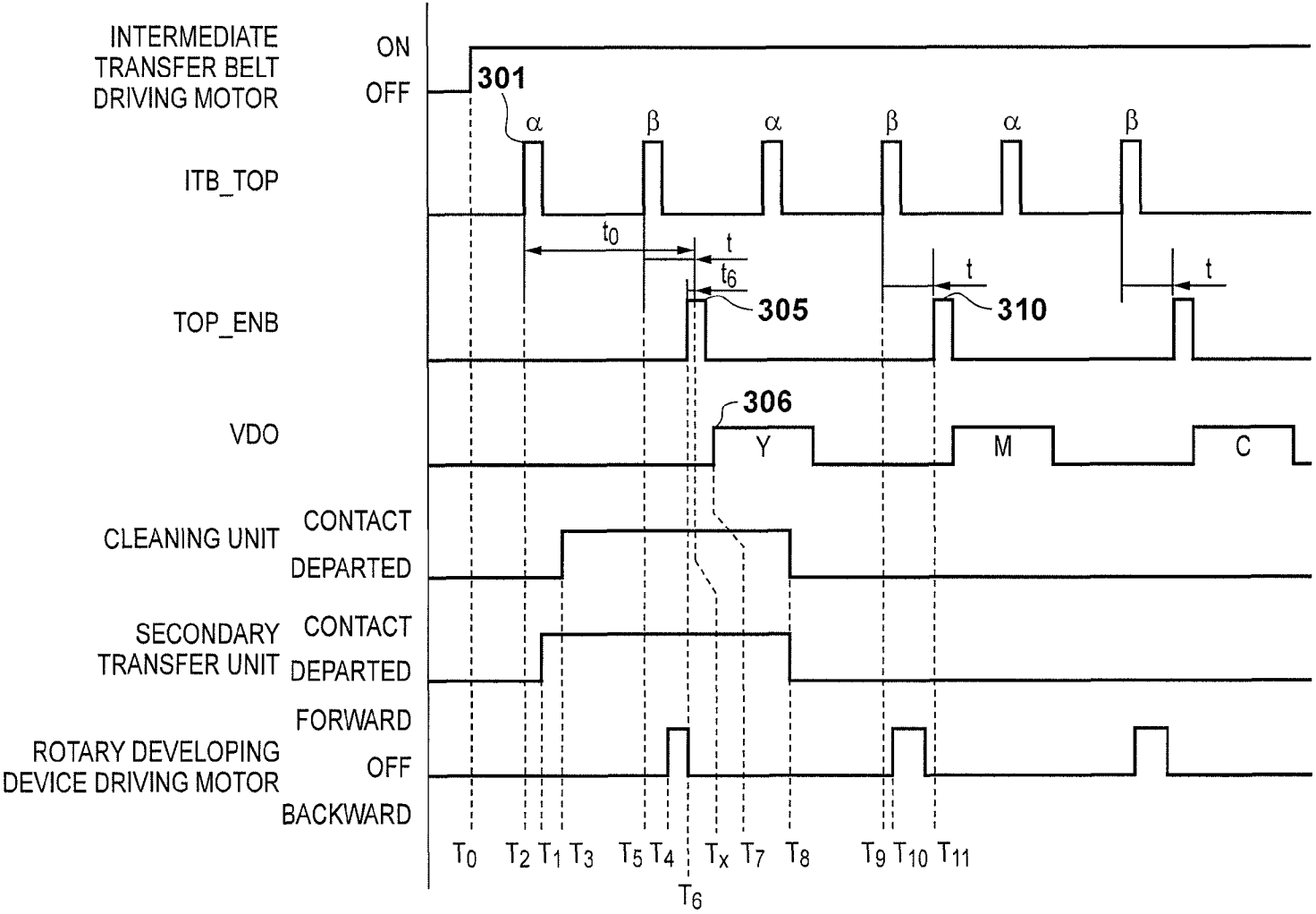
FIG. 15 is a timing chart illustrating the color misalignment correction sequence for the third rotary position.

According to FIG. 15, the CPU 121 determines the timing obtained by subtracting the correction value $t_6$ corresponding to the third rotary position from the Y exposure standby period $t_0$ as the above-described point in time $T_6$. Then, the CPU 121 measures the time period from the point in time $T_5$ until the point in time $T_6$, and retains the measurement result in the RAM 123 as an exposure synchronization time t. The CPU 121 determines the writing start timings for the second and subsequent colors by using the exposure synchronization time t without change. That is, the CPU 121 starts outputting the TOP_ENB signal at the point in time $T_{11}$, which is the point in time when exposure synchronization time t has elapsed from the point in time $T_9$ at which the marker 71*b* has been detected.

In this manner, a similar effect to the case in which the writing start timings for the second and subsequent colors are corrected is also obtained by correcting the writing start timing for the first color. Note that since the number of corrections is reduced, there is an advantage in reducing processing load on the CPU 121.

Embodiment 3

Positional Alignment of Toner Images of Respective Colors in Multi-Color Image in First Rotary Position (FIG. 1)

In Embodiment 3, description of matters in common with Embodiments 1 and 2 will be omitted. In the description of FIGS. 7 and 13, a case in which the relation between the reference point in time $T_5$ and the time period after the ITB_TOP signal is output until the exposure standby period $t_0$ elapses is measured, and color misalignment correction control is performed based on the measurement result. However, the invention is not limited to such an embodiment. Another embodiment for obtaining a similar correction result is shown in FIG. 16.

Figure 16:
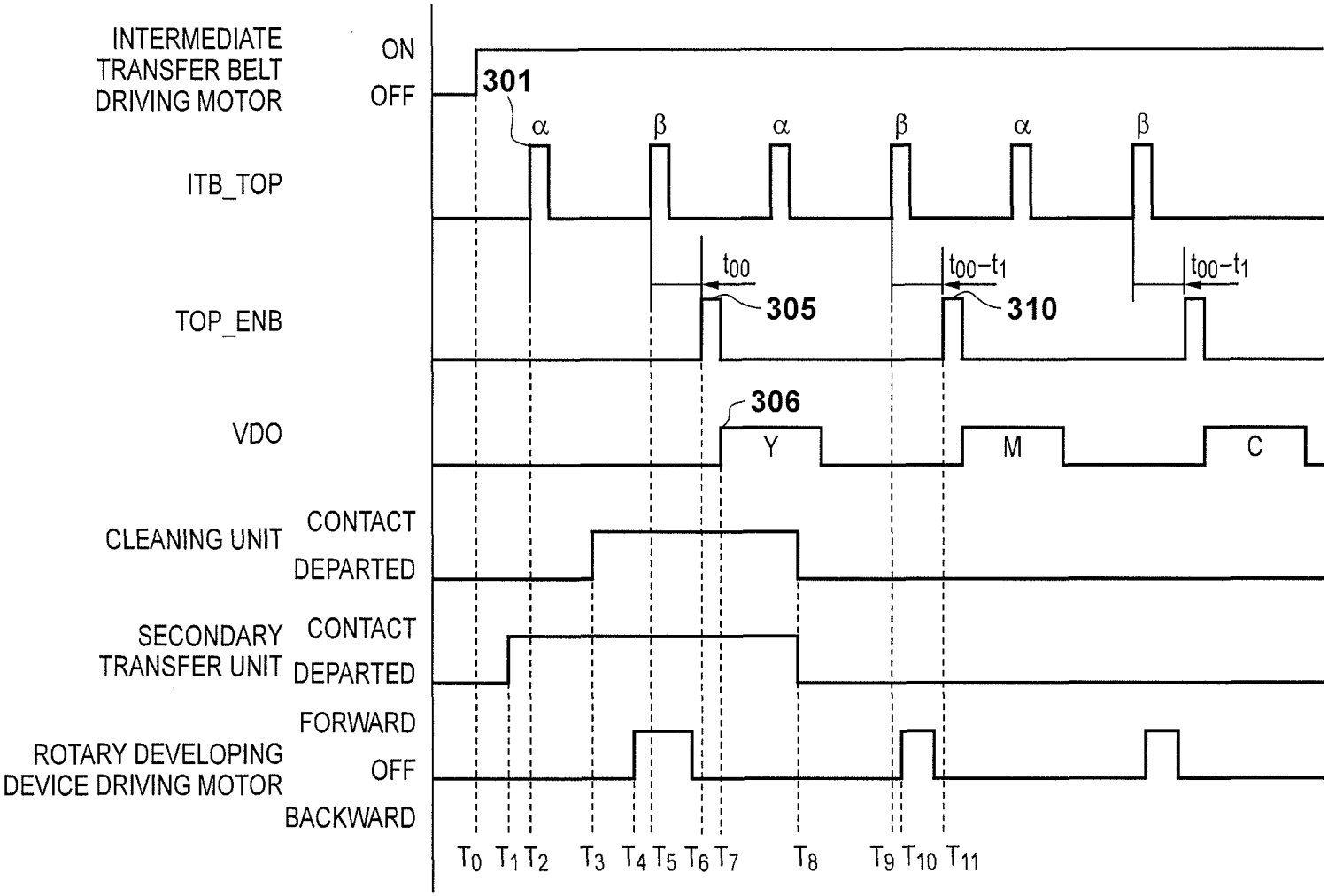
FIG. 16 is a timing chart illustrating another color misalignment correction sequence.

In FIG. 16, the CPU 121 outputs the TOP_ENB signal 305 to the exposure device 3 after a time $t_{00}$ has elapsed from the point in time $T_5$ at which the optical sensor 70 has detected the marker 71*b*. Then, the CPU 121 outputs the TOP_ENB signal 310 for magenta to the exposure device 3 at the point in time $T_{11}$, which is the point in time when a corrected exposure time $t_{00}-t_1$ has elapsed from the point in time $T_9$ at which the marker 71*b* has been detected. In addition, the CPU 121 similarly outputs the TOP_ENB signal after the corrected exposure time $t_{00}-t_1$ has elapsed for the other colors as well.

Also, with respect to the stoppage of the rotary developing apparatus 4 as shown in FIG. 8, in FIG. 16, correction may be made by using $(t_{00}-t_2)$ instead of $(t_{00}-t_1)$. With respect to the stoppage of the rotary developing apparatus 4 as shown in FIG. 10, in FIG. 16, correction may be made by using $(t_{00}+t_3)$ instead of $(t_{00}-t_1)$. Also, with respect to FIGS. 13, 14 and 15, t may be replaced by $t_{00}$.

By the method described above as well, a similar effect to Embodiments 1 and 2 may be obtained.

Other Embodiments

In the foregoing embodiments, a description is provided in which the exposure device 3 (image recording apparatus) corrects the exposure timing (image recording timing) of a light beam onto the photosensitive drum 1, thereby correcting the formation position of the toner image to be primary-transferred. However, the formation position of the toner image may be corrected by another method in order to obtain a similar effect. For example, the rotation speed of the photosensitive drum may be corrected so as to cancel the color misalignment according to an instruction by the CPU 121, instead of correcting the exposure timing (image recording timing), thereby correcting the formation position of the toner image to be primary-transferred.

Also, in the foregoing embodiments, a case is described in which the correction value is subtracted or added for correcting the exposure timing, but the positional correction may be performed by multiplying or dividing the correction value, for example. In this case, for example, it is sufficient to set a value for multiplying or dividing t with as a correction value, to obtain a value that is the same as $(t-t_1)$.

Also, in the foregoing description, a case is described in which contact (preparation operation) by the cleaning unit serving as the cleaning member is executed in response to detection of the marker 71*a*. However, the present invention is not limited to this, and the secondary transfer unit may be brought into contact in response to detection of the marker 71*a*. Note that in this case, the correction value may be set to a value determined by reflecting the mechanical shock due to the contact by the secondary transfer unit.

Also, in the foregoing description, a case is described in which contact (preparation operation) by the processing units (cleaning unit and the like) as an image formation preparation operation is executed in response to detection of the marker 71*a*. Here, also in the case where departure of the cleaning unit occurs during a period from the point in time $T_2$ to the point in time $T_5$ in FIG. 7, for example, the mechanical shock occurs. Accordingly, the foregoing embodiments may be performed also in the case where departure of the cleaning unit or the secondary transfer unit occurs in a period between detection of the marker 71*a* and detection of the marker 71*b*. Note that in this case, the correction value may be set to a value determined by reflecting the mechanical shock due to the departure.

Also, although the foregoing description uses the intermediate transfer belt 5*a* as an example of the rotating member on which the markers 71*a* and 71*b* are formed, the present invention is not limited thereto. For example, as a rotating member on which the markers 71*a* and 71*b* are formed, a transferring material bearing member that bears a recording material to which a toner image is to be primary-transferred and that rotates may be used.

Also, in the foregoing description, a case is described in which the preparation operation in which the processing units as defined above are caused to contact or depart from the intermediate transfer belt 5*a* or the like is executed in response to detection of the marker 71*a*. However, the preparation operation for image formation may be executed, for example, when a predetermined time has elapsed after the rotation of the intermediate transfer belt 5*a* has been started, rather than based on detection of the marker 71*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185580, filed Aug. 20, 2010 which is hereby incorporated by reference herein in its entirety.

What is claimed is:

1. An image forming apparatus comprising:

an image bearing member configured to bear a toner image;

an exposure unit configured to form a latent image on the image bearing member;

a development unit that includes a plurality of developing devices that each develop the latent image by using a toner of a different color, and rotates to switch the developing device contacting the image bearing member, such that another of the developing devices contacts the image bearing member;

a rotating member configured to operate as an intermediate transfer member onto which the toner image formed on the image bearing member is primary-transferred, or as a transferring material bearing member that bears a recording material onto which the toner image is primary-transferred and rotates; and a correcting unit configured to correct a formation position of a toner image according to a number of the developing devices passing through a developing position until the toner image is formed on the image bearing member after any one of the plurality of developing devices stops at the developing position by the development unit rotating the plurality of developing devices.

2. The image forming apparatus according to claim 1, wherein the correcting unit is configured to correct a formation position of a toner image using a first correction value in a case where a number of the development devices passing through a developing position is a first number, and correct the formation position of the toner image using a second correction value smaller than the first correction values in a case where a number of the development devices passing through the developing position is a second number less than the first number.

3. The image forming apparatus according to claim 1, wherein the development unit is configured to rotate to switch the developing device contacting the image bearing member, such that another of the developing devices contacts the image bearing member, and the correcting unit is configured to correct the formation position of the primary-transferred toner image, based on a correction value corresponding to a stop position at which the rotating member has stopped before the development unit starts rotation.

4. The image forming apparatus according to claim 3, wherein the correction value is a value corresponding to at least one of the number of times in which the developing device is caused to contact the image bearing member by rotating the development unit, and the number of times in which the developing device is caused to depart from the image bearing member by rotating the development unit.

5. The image forming apparatus according to claim 1, wherein a circumferential length of the rotating member is at least a length in a longitudinal direction of a recording medium of the largest size that can be used by the image forming apparatus for image formation, and also is less than twice the length.

6. The image forming apparatus according to claim 1, wherein the development unit and the rotating member share a motor for driving the development unit and the rotating member.

7. The image forming apparatus according to claim 1, further comprising a marker detecting unit configured to detect a marker that is formed on the rotating member and rotates with the rotating member; and a control unit configured to perform, before a toner image is formed on the rotating member, a preparation operation in which a processing unit is caused to contact or depart from the rotating member, wherein the correcting unit, after part of the preparation operation is finished, is configured to correct a timing at which the exposure unit forms the latent image to correct a formation position of the primary-transferred toner image by using a timing at which the marker is detected by the marker detecting unit as a reference.

8. The image forming apparatus according to claim 7, wherein the marker detecting unit is configured to detect a plurality of markers, the control unit is configured to perform the preparation operation by using, as a reference, a timing at which a first marker out of the plurality of markers is detected, and the correcting unit is configured to correct the timing at which the exposure unit forms the latent image to correct the formation position of the toner image to be primary-transferred by using, as a reference, a timing at which a second marker is detected following the detection of the first marker.

9. The image forming apparatus according to claim 8, wherein the processing unit comprises a cleaning member that cleans the rotating member, and part of the preparation operation is an operation in which the cleaning member contacts or departs from the rotating member in a time period from the timing at which the first marker is detected by the marker detecting unit to the timing at which the second marker is detected by the marker detecting unit.

* * * * *